United States Patent [19]

Scafaro

[11] 4,289,050

[45] Sep. 15, 1981

[54] EXPANSION TOOL

[76] Inventor: Vincent J. Scafaro, 4715 W. Laurel La., Glendale, Ariz. 85304

[21] Appl. No.: 53,256

[22] Filed: Jun. 29, 1979

[51] Int. Cl.[3] ..... B25B 7/02

[52] U.S. Cl. ..... 81/311; 81/302; 81/420

[58] Field of Search ..... 81/302, 420, 418, 341, 81/303-312, 385-392, 395-404, 425 R, 425 A, 426; 29/268, 239; 269/237, 47; 294/97, 16

[56] References Cited

U.S. PATENT DOCUMENTS

| | | | |
|---|---|---|---|
| 505,835 | 10/1893 | Kulp et al. | 81/302 |
| 792,374 | 6/1905 | Wolford | 81/302 |
| 1,399,665 | 12/1921 | Shapiro | 81/302 |
| 3,314,319 | 4/1967 | Schmidt | 81/420 |
| 3,617,044 | 11/1971 | Strange | 81/420 |
| 3,654,755 | 4/1972 | Bell | 81/302 |
| 3,677,129 | 7/1972 | Lyon | 81/302 |

*Primary Examiner*—James L. Jones, Jr.
*Attorney, Agent, or Firm*—Harry M. Weiss

[57] ABSTRACT

An expansion tool for spreading the side walls of a partitioning track comprises first and second members each having a handle portion and a jaw portion. These members are coupled together so as to cause the jaw portions to compress when the handles are compressed. Coupled to each jaw portion is a spreading member each of which includes a contact or spreading surface. As the jaws are compressed, the contact surfaces move apart.

7 Claims, 4 Drawing Figures

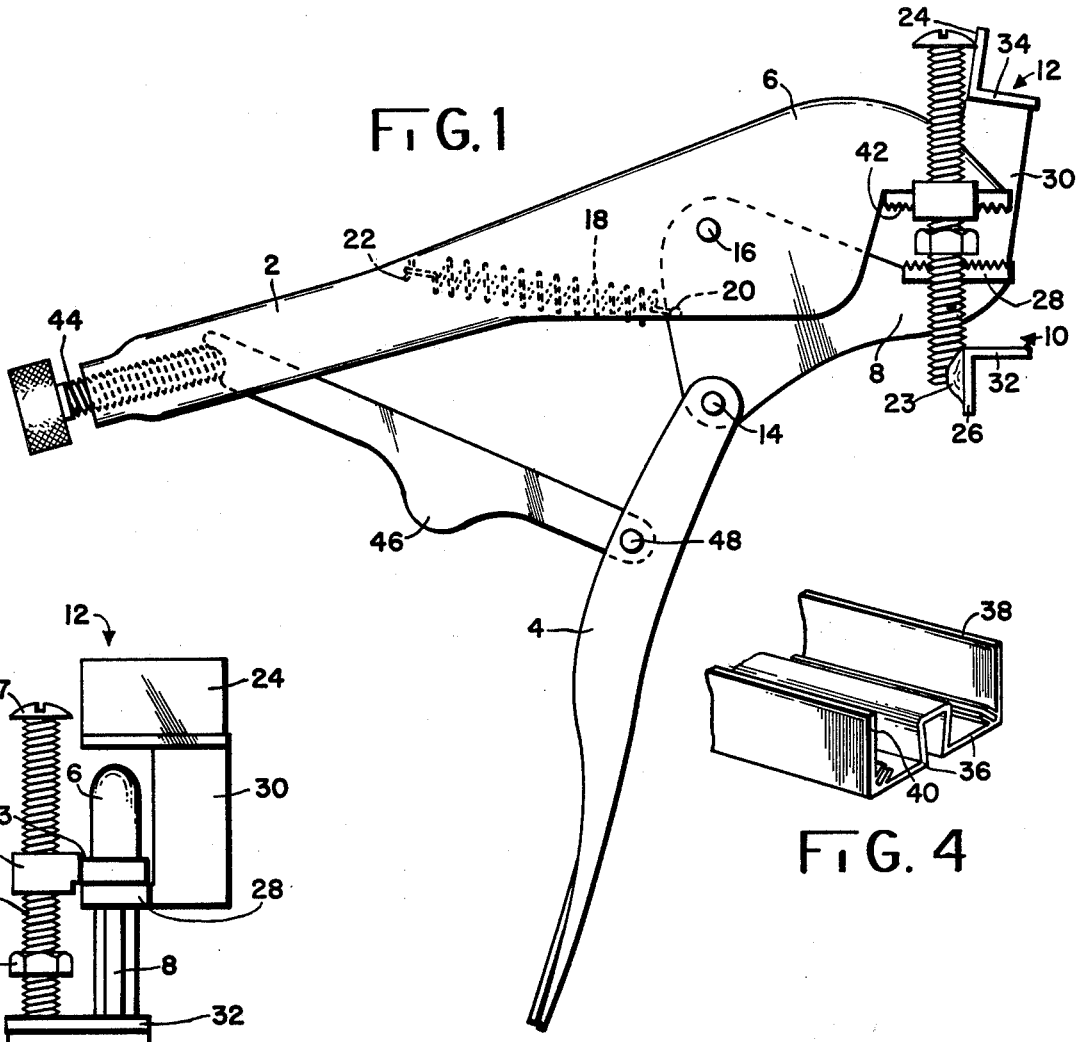
FIG. 1
FIG. 4
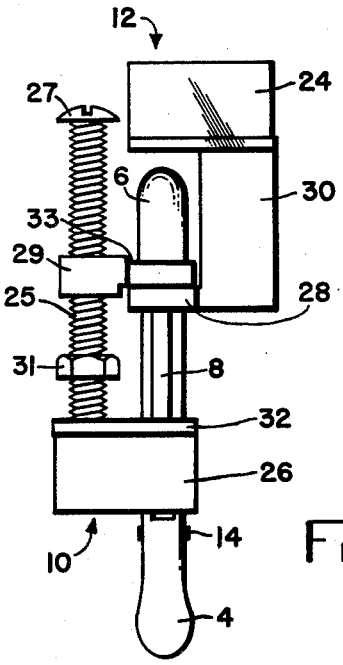
FIG. 3
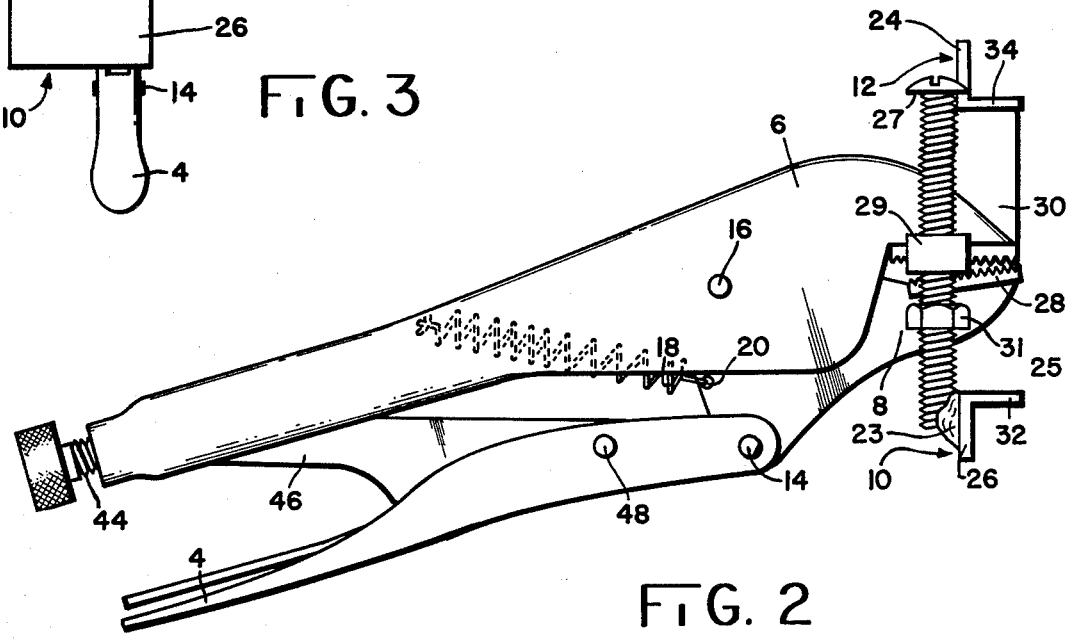
FIG. 2

EXPANSION TOOL

BACKGROUND OF THE INVENTION

1. Field of the Invention

This invention relates generally to expansion pliers and, more particularly, to a manually operable tool for spreading the side walls of partitioning tracks.

2. Description of the Prior Art

Adding partitions to existing structures may be accomplished by first securing a track to the ceiling or other form of overhead member and inserting and partitioning sheets of sheet-rock within the track. The sheet-rock then extends from the track to the floor below to form the desired partition. In order to provide a sturdy partition, the track must securely house the upper edge of the sheet-rock; i.e. the width of the track can be only slightly greater than the width of the sheets of sheet-rock, to be inserted therein.

As a result of this small tolerance, it is very difficult to position the sheet-rock within the track without first forcing apart the track side walls. Attempts to do this with conventional hand tools such as screwdrivers and the like generally fail and are likely to damage the track and perhaps the sheet-rock. Furthermore, the tracks may vary in width from manufacturer to manfacturer adding to the difficulty of using conventional tools.

Many forms of expandable pliers which perform specific spreading-type operations are known. For example, U.S. Pat. No. 1,155,288 describes an expandable plier type tool for spreading horseshoes, and U.S. Pat. No. 3,540,106 describes an expandable brake cable release tool. U.S. Pat. No. 3,571,894 describes an expandable type pliers for removing snap rings, and U.S. Pat. No. 2,553,620 describes a parallel expanding jaw pliers in which each of the jaw members is provided with means to detachably secure specially shaped elements. However, none of the known devices are suitable for spreading the side walls of partitioning tracks to facilitate entry of the partitioning members.

SUMMARY OF THE INVENTION

It is an object of the present invention to provide an inexpensive tool for spreading the side walls of partitioning tracks.

It is a further object of the invention to provide an expansion tool which will uniformly engage the side walls of tracks and provide a spreading force outwardly thereon.

It is a still further object of the invention to provide a track spreader capable of use in conjunction with tracks of different widths.

Yet another object of the invention is to provide an expansion tool which also features a compression gripping action.

Finally, it is an object of the invention to generally improve on and extend the usefulness of pliers having a vicegrip action.

According to a broad aspect of the invention there is provided an expansion tool for spreading the side walls of a longitudinal track member, said track member having a base and first and second side walls extending therefrom comprising, a first member having a first handle portion and a first jaw portion; a second member having a second handle portion and a second jaw portion; means of coupling said first and second members at points intermediate thereof for moving said second jaw portion towards said first jaw portion when said first and second handle portions are compressed; and first and second spreading members coupled to said first and second jaw portions respectively, said second jaw portions forcing said second spreading member away from said first spreading member when said first and second handle portions are compressed.

According to a further aspect of the invention there is provided, an apparatus for converting a compression tool into an expansion tool, said compression tool of the type which includes first and second jaws which are caused to move together when first and second handles are moved towards each other comprising, first and second spreading means for coupling to said first and second jaws, each of said spreading means comprising a lip member coupled to one of said jaws and extending past the other of said jaws and a contact member coupled to said lip member and extending therefrom.

The above and other objects, features and advantages of the invention will be more clearly understood from the following detailed description taken in conjunction with the accompanying drawings, in which:

BRIEF DESCRIPTION OF THE DRAWINGS

FIG. 1 is a side view of the inventive expansion tool in an open or insertion position.

FIG. 2 is a side view of the expansion tool of FIG. 1 in a closed or spreading position.

FIG. 3 is a front view of the expansion tool of FIGS. 1 and 2 illustrating the spreading members in more detail.

FIG. 4 is an isometric view of a partitioning track of a type with which the inventive expansion tool may be used.

DESCRIPTION OF THE PREFERRED EMBODIMENT

Referring to FIG. 1, the inventive expansion tool comprises six basic sections. These are handle members 2 and 4, jaw members 6 and 8, and spreading members shown generally at 10 and 12. While jaw member 6 is formed integrally with handle 2, jaw member 8 is pivotably coupled to handle 4 at pin 14. Jaw member 8 is also coupled to handle 2 by means of pivot pin 16 and spring 18, which spring engages an aperture 20 in jaw member 8 and protrusion 22 in handle 2. Handle members 2 and 4, are mechanically coupled by cross member 46.

Referring briefly to FIG. 4, there is shown a typical partitioning track having base member 36 and side wall members 38 and 40. The expansion tool shown in FIGS. 1, 2, and 3 can be inserted into the track and activated to spread side walls 38 and 40 in a manner to be described below.

Referring to FIGS. 1 and 3, each of the spreading members comprises a contact member for engaging one of the track side walls and an overhang or lip member coupled to the contact member and extending substantially perpendicularly therefrom for engaging the upper edge of one of the track side walls. Thus, spreading member 12 comprises contact member 34 and overhang member 24. Spreading member 10 comprises contact member 32 and overhang member 26.

Spreading member 12 is coupled to the lower jaw member 8 by means of a base member 30. That is, contact member 34 is coupled to base member 30 and extends substantially perpendicularly therefrom. Base member 30 is fixedly coupled to lower jaw member 8 at 28. That is, base member 30 may be attached to jaw 8 by, for example, welding or may be formed integrally therewith.

Spreading member 10 is coupled to upper jaw member by means of bolt 25 having a slotted head 27 and an internally threaded nut 29 which is fixedly coupled to upper jaw member 6 at 33, for example, by welding; contact member 32 is likewise fixedly coupled, as by welding, to a lower portion 23 of bolt 25. By rotating bolt 25, the distance between contact members 32 and 34 may be varied so as to accommodate tracks of different widths. An additional nut 31 mounted for free rotation on bolt 25 may serve as a marker for providing quick adjustment of spreading member 10 to a desired width.

FIG. 1 illustrates the inventive expansion tool in a contracted position ready for insertion into the track. After insertion, handles 2 and 4 are manually brought closer together causing jaws 6 and 8 to move towards each other (compression) thus causing contact members 32 and 34 to move away from each other and lock in an expanded position forcing the track side walls apart. It is to be noted that the entire surface area of the contact members engage the side walls. This reduces the chances of damage, such as crimping to the walls.

FIG. 3 illustrates the expansion tool with the spreading members fully expanded. It should be appreciated that in this position, jaw members 6 and 8 have been forced closer together. Thus, the expansion tool may alternatively perform traditional gripping functions. To this end, jaws 6 and 8 may be provided with teeth as is shown at 42.

As is well known in the art, the expansion tool may be provided with an adjustable screw assembly 44 which engages threads in handle 2. The screw assembly engages cross member 46 which is pivotably coupled to handle 4 at 48. By adjusting the screw assembly, the amount of expansion between members 10 and 12 can be further varied.

The above description of a preferred embodiment is given by way of example only. Certain changes in form and details would be obvious to the skilled practitioner. For example, by properly contouring the surfaces of the spreading member, the inventive expansion tool may be used in conjunction with tracks having a cross-section which is other than rectangular. These and other modifications may be made without departing from the spirit and scope of the invention as defined by the appended claims.

What is claimed is:

1. An expansion tool for spreading the side walls of a longitudinal track member, said track member having a base and first and second side walls extending therefrom comprising:

a first member having a first handle portion and a first jaw portion;

a second member having a second handle portion and a second jaw portion;

means coupling said first and second members at points intermediate thereof for moving said second jaw portion towards said first jaw portion when said first and second handle portions are compressed;

first and second spreading members coupled to said first and second jaw portions respectively, said second jaw portion forcing said second spreading member away from said first spreading member when said first and second handle portions are compressed;

said first spreading member comprising a base member coupled to said first jaw portion for engaging transversely the base of said track;

said first spreading member further comprising a first contact member coupled to said base member and extending substantially perpendicularly therefrom for engaging one of said first and second side walls;

said first spreading member further comprising a first overhang member coupled to an edge of said first contact member opposite said base member, said first overhang member extending substantially perpendicularly from said first contact member and in a direction away from said base member;

said second spreading member comprising a second contact member for engaging the other of said first and second side walls; and adjusting means for coupling said second contact member to said second jaw portion and capable of altering the position of said second contact member with respect to said second jaw portion.

2. An expansion tool according to claim 1 wherein said second spreading member further includes a second overhang member coupled to an edge of said second contact member and extending perpendicularly therefrom.

3. An expansion tool according to claim 2 wherein said adjusting means comprises:

a first internally threaded member fixedly coupled to said second jaw portion;

an externally threaded longitudinal member coupled for rotation within said first internally threaded member, said longitudinal member fixedly coupled to said second spreading member.

4. An expansion tool according to claim 3 further including a second internally threaded member coupled for free rotation on said externally threaded member between said first internally threaded member and said second spreading member.

5. An expension tool according to claim 4 wherein each of said contact members is shaped to uniformly engage one of said first and second side walls over an entire surface area of said contact member.

6. An expansion tool according to claim 5 further including means for locking said tool in an expanded position.

7. An expansion tool according to claim 6 further including means for varying the amount of expansion.

* * * * *